US006189268B1

(12) United States Patent
Carr et al.

(10) Patent No.: US 6,189,268 B1
(45) Date of Patent: Feb. 20, 2001

(54) MODULAR OFFICE FURNITURE SYSTEM

(75) Inventors: Roger John Carr, Surrey (GB); John Judson Jaqua, III, Bloomington, IN (US)

(73) Assignee: Paoli, Inc., Orleans, IN (US)

( * ) Notice: Under 35 U.S.C. 154(b), the term of this patent shall be extended for 0 days.

(21) Appl. No.: 09/325,991

(22) Filed: Jun. 4, 1999

(51) Int. Cl.[7] ..... A47F 10/00

(52) U.S. Cl. ..... 52/36.1; 52/36.5; 52/220.7; 52/239

(58) Field of Search ..... 52/32, 36.1–36.6, 52/239, 220.7, 220.3, 220.2; 108/50.02, 42, 47, 48, 106–109, 144; 312/194, 195, 223.6, 223.3, 223.2; 174/48

(56) References Cited

U.S. PATENT DOCUMENTS

| | | | | |
|---|---|---|---|---|
| 4,133,507 | | 1/1979 | Chervenak . | |
| 4,323,291 | | 4/1982 | Ball . | |
| 4,372,629 | | 2/1983 | Propst et al. . | |
| 4,601,137 | | 7/1986 | Bates . | |
| 4,688,748 | | 8/1987 | Pruyser . | |
| 4,852,500 | | 8/1989 | Ryburg et al. . | |
| 4,928,913 | | 5/1990 | Laughon et al. . | |
| 5,144,896 | | 9/1992 | Fortsch . | |
| 5,172,529 | * | 12/1992 | Van De Riet | 52/220.7 |
| 5,209,035 | * | 5/1993 | Hodges et al. | 52/220.7 |
| 5,265,952 | | 11/1993 | Greshem et al. . | |
| 5,301,477 | | 4/1994 | Rellinger et al. . | |
| 5,352,033 | | 10/1994 | Gresham et al. . | |
| 5,383,318 | | 1/1995 | Kelley et al. . | |
| 5,394,658 | * | 3/1995 | Schreiner et al. | 52/36.1 |
| 5,428,928 | | 7/1995 | Hellwig et al. . | |
| 5,638,758 | | 6/1997 | Carr . | |
| 5,651,219 | * | 7/1997 | Balogna et al. | 52/32 |
| 5,675,946 | * | 10/1997 | Verbeek et al. | 52/36.1 X |
| 5,686,700 | | 11/1997 | Carpinella . | |
| 5,715,761 | | 2/1998 | Frattini . | |
| 5,718,179 | | 2/1998 | Johnson et al. . | |
| 5,724,778 | * | 3/1998 | Cornell et al. | 52/239 |
| 5,765,315 | | 6/1998 | Nagamitsu et al. . | |
| 5,890,325 | * | 4/1999 | Corcorran et al. | 52/36.1 |
| 5,899,025 | * | 5/1999 | Casey et al. | 52/36.1 |
| 5,970,662 | * | 10/1999 | Corcorran et al. | 52/36.1 |
| 5,979,118 | * | 11/1999 | Gortsema et al. | 52/36.1 |
| 5,994,644 | * | 11/1999 | Rindoks et al. | 52/220.7 X |

FOREIGN PATENT DOCUMENTS

| | | | | |
|---|---|---|---|---|
| 592248 | * | 4/1994 | (EP) | 52/220.7 |

OTHER PUBLICATIONS

Weyel duraboard Info–Hängeleisten System Brochure.
Orbit System office furniture brochure.
Häfele Multi Purpose Pole Mount System Brochure.

* cited by examiner

*Primary Examiner*—Richard Chilcot
(74) *Attorney, Agent, or Firm*—Saidman DesignLaw Group

(57) ABSTRACT

The Village Wall system utilizes furniture, equipment, components, and accessories in the creation of unique office designs. Two parallel rails are attached to existing walls and support fixed tackboards and rolling accessories, e.g., markerboards, shelves, bookcases, etc. An outrigger beam is releasably connected, orthogonally, anywhere along the length of one of the rails. The other end of the outrigger beam is fixed to a pedestal which rotatably supports a work surface. Electrical power and communication services are provided through a wire managing service zone attached to the existing wall, a wire managing channel formed in the outrigger beam, a wire and cable storage facility within the interior of the pedestal, and through a grommet to the top of the work surface. Work areas without walls are defined by the location of the work surface along the existing wall.

38 Claims, 13 Drawing Sheets

14
72
70
20
58
74
56
64
34
12
66
60
62
18
30
22
32
36
48
44
38
68
46
50
52
54

MODULAR OFFICE FURNITURE SYSTEM

BACKGROUND OF THE INVENTION

1. Field of the Invention

This invention relates to a system of modular office furniture and accessories which combine to provide versatility in design and function for a wide variety of office arrangements.

2. Description of Related Art

It is known to hang office accessories on a wall.

Tackboards, e.g., bulletin boards made of sheets of cork or compressed paper, are commonly found attached to walls in offices, as are hanging markerboards (blackboards, whiteboards), shelves, lights, clocks, etc. Representative prior art showing same include Chervenak, U.S. Pat. No. 4,133,507 (cabinets), Laughon et al. U.S. Pat. No. 4,928,913 (shelves), Rellinger et al. U.S. Pat. No. 5,301,477 (whiteboards), and Nagamitsu et al. U.S. Pat. No. 5,765,315 (markerboards). The accessories of Chervenak, Laughon et al. and Rellinger et al. merely hang on hooks or the equivalent. Nagamitsu et al. provide a single writing board for rolling, parallel movement along the wall in front of cabinets.

Wire management has been a subject of inventive endeavor for some time.

Routing wires or cables through channels formed in furniture components is well known, as is covering the slots running along the channels with flexible materials. Propst et al. U.S. Pat. No. 4,372,629 show a wire manager including a brush covering a slot between a wire housing channel and a work surface attached thereto. Wires may exit at any point along its length in order to minimize the distance between power or communication outlets and their associated utility devices on said work surface, thereby minimizing cable clutter. Fortsch U.S. Pat. No. 5,144,896 discloses a flexible flap covering an entrance to a wire manager channel attached to the underside of a work surface. Wires exiting along its length are held in place by being pinched. Frattini, U.S. Pat. No. 5,715,761 discloses a flexible flap covering an entrance to a wire manager channel formed in at least one of the legs of a table. Ryburg et al. U.S. Pat. No. 4,852,500 disclose wire managing channels within an integrated work station for servicing computer-related components attached thereto. The work station, which is movable around a floor as a unit, comprises a computer-housing panel, a monitor mounted on the panel, a work surface pivotally cantilevered on a horizontal beam extending from the panel, and the computer-related components. The manner of providing power and communication cables to the work station is not disclosed. Ryburg et al. provide for limited movement of their monitor and work surface relative to the panel in order to afford minor adjustments for comfort of the user. Service for removable peripherals is not provided. Hellwig et al. U.S. Pat. No. 5,428,928 disclose a non-rotatable work surface adjustably secured along a partition. Wire managing channels are attached to the work surface with the wires and/or cables outside the channels laying on the floor. Each of these prior art patents incorporate their wire managers into the work surface structure where it is fixed and thereby of localized utility.

Bates U.S. Pat. No. 4,601,137 and Kelley et al. U.S. Pat. No. 5,383,318 provide wire and cable management raceways fixed to temporary walls or partitions. Bates hinges a service access panel to his raceway, said panel being latched with hook and loop-type fasteners (such as VELCRO™ brand fasteners), and Kelley et al. snap-fit an access service panel to their raceway, the service panels allowing access to the raceways. The service panels cover the wires and cables but do not appear to provide any egress for them.

Many prior patents show a pedestal or pedestal-like structure for supporting a work surface. Most are nothing more than a framework resting on a leg. Examples include patents to Pruyser U.S. Pat. No. 4,688,748, Ball U.S. Pat. No. 4,831,791, Ryburg et al. supra, Greshem et al. U.S. Pat. No. 5,265,952, Gresham et al. U.S. Pat. No. 5,352,033, Hellwig et al. supra, and Johnson et al. U.S. Pat. No. 5,714,179. None of these patents permit rotation of the work surface about the supporting pedestal.

Carr U.S. Pat. No. 5,638,758, and Carpinella U.S. Pat. No. 5,686,700, show a pedestal grommet and a pedestal, to provide electrical services to work surfaces, but both appear to be independent structures, separate from and unattached to their associated work surfaces.

A few examples exist of work surfaces, and thereby the work area, being adjustable linearly along a wall. Ball, supra, divides an area by partitions including a framework comprising a portable rail along which work surface supports are adjustably attached. Once their locations are selected, the supports are bolted to the rail. Work surfaces are then bolted to the supports. Ryburg et al. supra, slidably connects a cantilevered beam to a movable hardware/support panel. A work surface is rotatably connected at its near end to said beam for angular adjustments relative to said panel. Movement of the work surface is limited by the necessity to remain in close proximity to a monitor which is also slidably connected to said panel. Hellwig et al. supra, releasably locks a work surface along and to a partitioning panel via a connecting section. The work surfaces do not rotate, and wire management is provides solely through channels formed in the table support structure from cables apparently openly tranversing the floor.

While the above-mentioned patents provide benefits within their own isolated spheres of invention, they do not cooperate to produce the additional benefits produced by the present invention as described in detail below.

OBJECTS AND SUMMARY OF THE INVENTION

The present invention provides a wire manager comprising an electrical service panel assembly including horizontally spaced support brackets, each bracket having two vertical panel-engaging surfaces. Each vertical surface preferably includes a piece of hook-and-loop fastening material attached thereto (as used herein, the term "hook-and-loop fastener" is intended to mean any type of suitable type of hook and loop fastener including, but not limited to, VELCRO™ brand fasteners). A plurality of rectangular panels are removably attached to the panel-engaging surfaces of the support brackets. An elongated slot above the panels extends the entire length of the assembly. A flexible brush strip covers the elongated slot and is adapted to allow insertion of electrical cords and cables. The electrical service panel assembly is designed to be attached to existing walls and can utilize existing electrical outlets and jacks or be fed services from independent sources.

The present invention further comprises a rail system upon which office equipment can be attached, the rail system comprising two wall-mounted rails, at least one fixed panel, e.g., a tackboard, mounted between the two rails, a plurality of slidable panels arranged in two parallel layers, the panels riding on rollers which allows the panels to slide horizontally along the rails, and various office equipment, including cabinets, shelves, lamps, etc., that are designed to be attached to one or both of the rails and/or to the slidable panels.

The present invention further comprises a work surface including a floor-standing pedestal pivotably supporting one end of the work surface, two legs mounted on casters that support the free end of the work surface, and an outrigger beam that connects the pedestal to the wall. The outrigger beam is slidably attached to one of the horizontal rails mounted on the wall.

The present invention further includes a cable management system for the work surface comprising the outrigger beam including an elongated horizontal slot covered by a flexible flap, the pedestal including an internal channel which provides a passage for cables from the outrigger beam to the top of said work surface, a cable storage area, and an electrical outlet strip storage area. A grommet closes the top of the pedestal and provides access to the cable and electrical outlet strip storage areas for allowing the cables, etc., to egress onto the work surface from the pedestal.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

The modular office furniture system of the present invention comprises a product group of furniture, components, and accessories which provides office workers with the ability to arrange their workspaces for specific tasks, without compromising the level of order that designers and facilities managers desire. It furthers the goals of mobility, adaptability, and user control for designing office environments.

In the past, individual or group office spaces were defined by extensive utilization of cubicles separated by temporary or permanent walls. These modes tended to isolate people which not only promoted a feeling of living in solitary confinement, it also inhibited the free flow of ideas. The modular office furniture system of the present invention eliminates the walls and thereby opens the workspace. The floor area is divided into distinct zones: areas assigned to individuals, groups, or for business functions, such as for lectures, meetings, presentations, training, or to greet clients and customers. Each area is unbounded with no walls to restrict office designs to outdated needs. As the needs change, so can office assignments. In addition, the workspace can be redesigned with nothing to tear down or rebuild. This is accomplished by mounting wall assemblies on existing walls and adjustably tethering work surfaces to the wall assemblies. The work surfaces, and thereby their associated work areas, can be reassigned merely by tethering them to the wall assemblies at different locations.

Electrical and communication services are also provided without the need to destroy or rebuild existing structures. Service zones are mounted directly to existing walls to house the wires and cables needed, thus providing clean, unobtrusive management thereof. Connection of the data sources to computers and other office equipment on the work surfaces or in the work areas is facilitated by the unique combination of the service zones, the work surfaces, and special outrigger beams tethered therebetween. Access to electrical and communication connections are possible anywhere along the length of the service zone.

Figure 1:
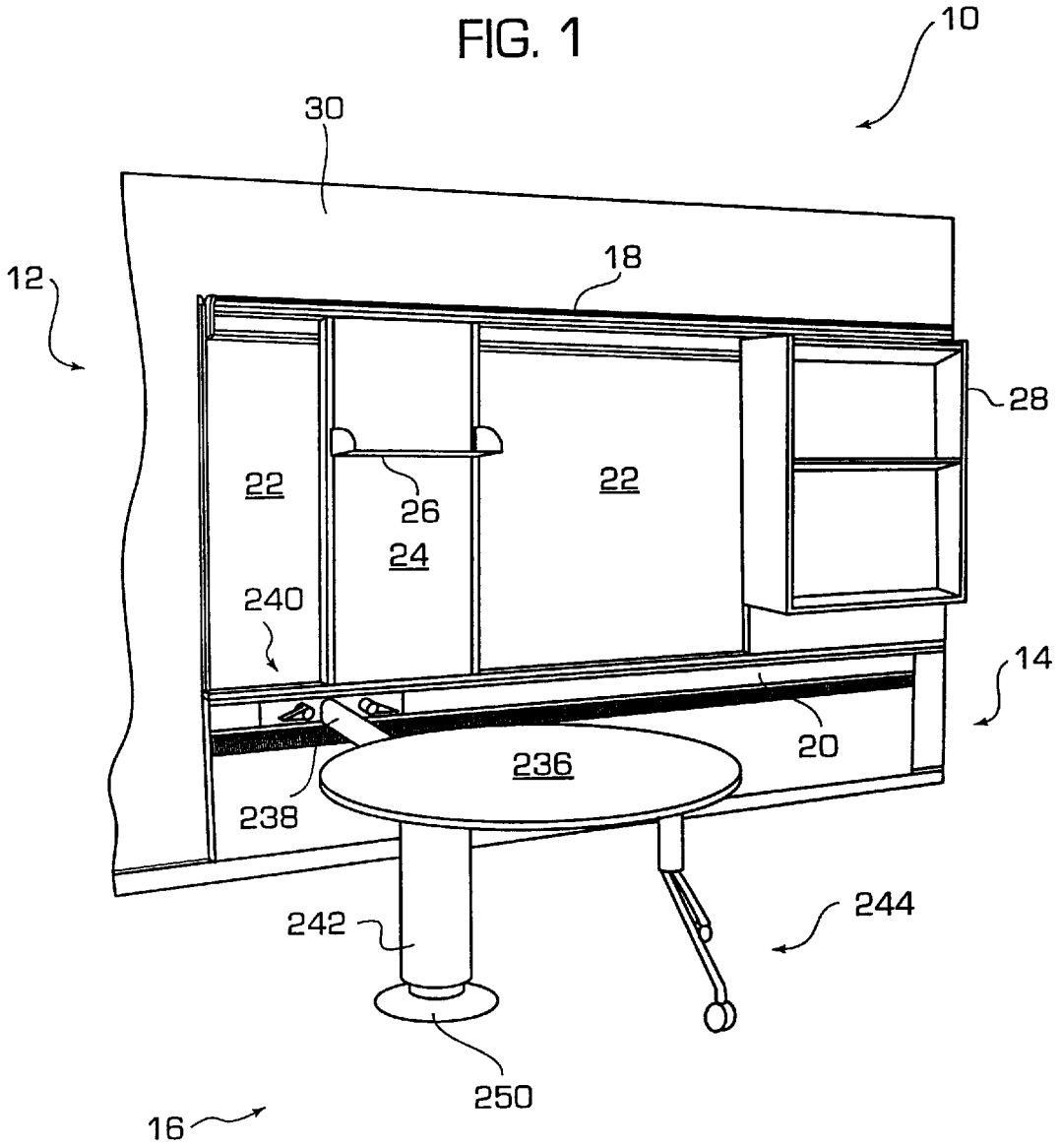
FIG. 1 is a perspective view which illustrates one preferred arrangement of the present invention.

Turning to FIG. 1, modular office furniture system 10 of the present invention is exemplified in this example by a wall assembly 12, a service zone 14, and a utility area 16. Depending on the furniture and accessories included in it, utility area 16 is adaptable for any desired function, be it a work area, meeting area, private or group office, presentation space, or conference room. The example illustrated in FIG. 1 is but one of innumerable permutations of the concept of the modular office furniture of the present invention, as will become readily apparent in view of the following.

Wall assembly 12 is the backbone of the modular office furniture system of the present invention and preferably example comprises an upper rail 18, a lower rail 20, tackboards 22, and any of a multitude of rail supported accessories including those shown here, namely, an accessory rail panel 24 with shelf 26 and an open bookcase 28. Other rail supported accessories include markerboards, shelves, closed bookcases with or without drawers and/or tambour doors, laptop docks, presentation easels, display shelves, and accessory bars. All come in a variety of widths, most usually 18 or 36 inches, but modular office furniture system of the present invention is not limited to any particular sizes of components. Wall assembly 12 is mounted on an existing wall 30.

Figures 2A, 2B:
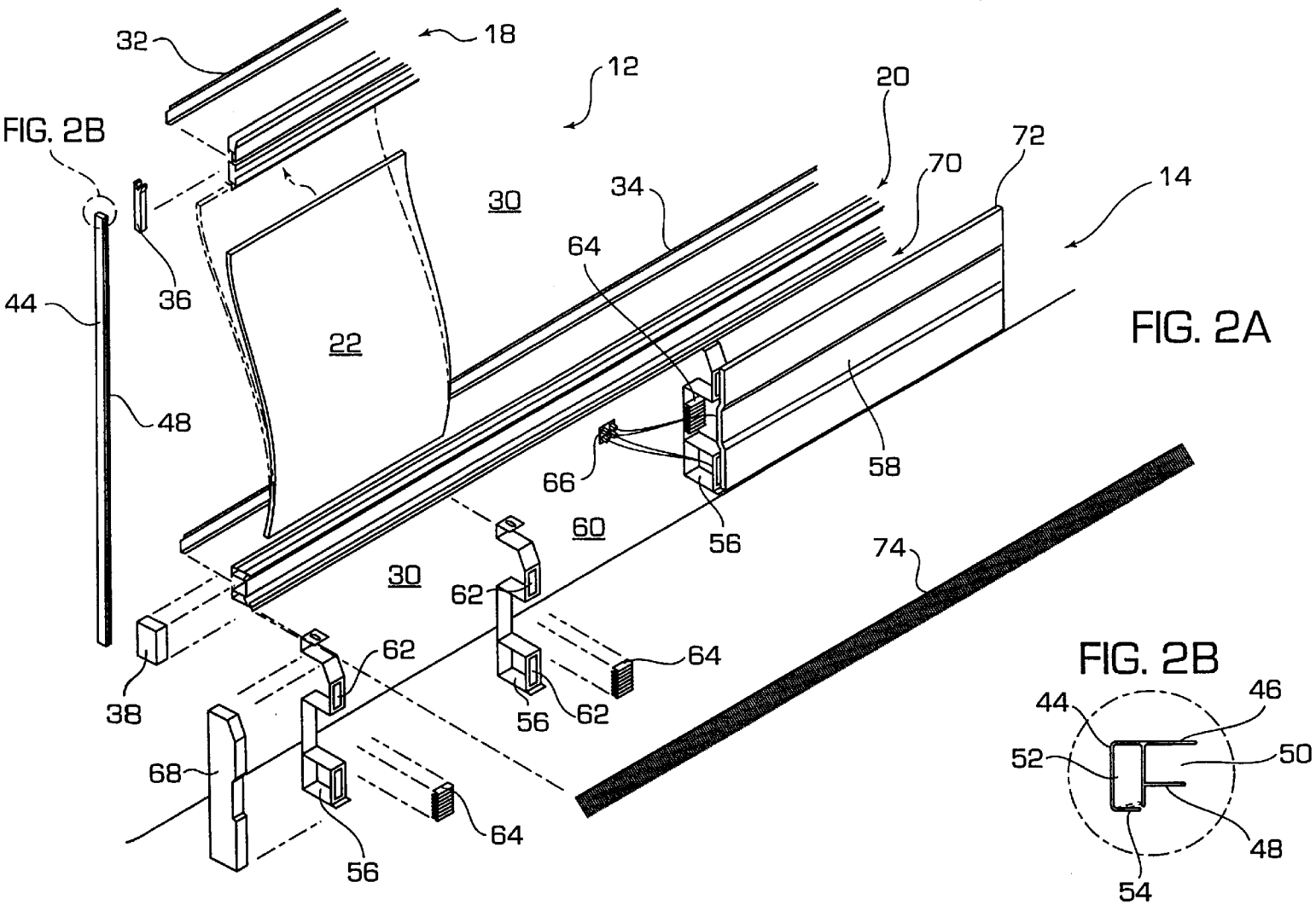
FIG. 2A is an exploded perspective view of the wall assembly and service zone of the present invention.
FIG. 2B is a top view of the tackboard endcap and wire manager as viewed within the dotted circle in FIG. 2A.

Referring to FIG. 2A, wall assembly 12 is shown in an exploded perspective view. An upper hanger bracket 32 and a lower hanger bracket 34, both preferably made of steel, are mounted directly to wall 30 and support upper rail 18 and lower rail 20, respectively, in a manner to be described. An upper end cap 36 covers any exposed end of upper rail 18, and a lower end cap 38 performs the same function for lower rail 20.

Tackboards 22 (only one is shown in FIG. 2A but enough may be provided to extend the full length of the wall assembly as shown in FIG. 1) are inserted into notches (to be described) in upper and lower rails 18, 20. Tackboards 22 provide a background surface adaptable for tacking displays of a relatively permanent nature, e.g., pictures, graphs, notices, memos, directives, etc. Decorative coverings of various materials, patterns, textures, and colors allow tackboards 22 to aid in the creation of unique and personalized interiors, a function which expands the versatility of tackboards 22 beyond being mere bulletin boards. Upper and lower rails 18, 20 are often used without tackboards, if wall 30 is such that it is desirable not to hide any natural beauty thereof. For example, when installing modular office furniture system of the present invention on an old, historic brick surface, it may be desirable to allow the brickwork to show through.

A tackboard endcap 44 covers the exposed edge of tackboard 22 to provide a finished look to wall assembly 12. FIG. 2B shows a top view of tackboard endcap 44 where flanges 46 and 48 define a slot 50 for receiving the exposed edge of tackboard 22. Flanges 46, 48 stop short of the ends of endcap 44 which overlap endcaps 36, 38. Where needed, endcap 44 may double as a wire manager. A channel 52 extends the full height of tackboard endcap 44 and may receive, distribute, and conceal wires and/or cables. A flap 54 is flexible, as indicated by the dashed lines, and provides access to channel 52 for insertion and removal of wires and/or cables.

Service zone 14 comprises a means for adding electrical and communication services to modular office furniture system of the present invention. When a building is initially designed as a specific office for a specific purpose, electrical and data communication services are usually installed in the walls as they are erected. Wallboard or panelling then covers and hides the wires and cables. If the need for such services is not anticipated, wires and cables may not be installed at all, leaving the adjoining spaces without service. The obvious disadvantages of these alternatives, of course, is that as needs change, either the walls must be ripped apart to change the services required, or exposed, unsightly wires and cables must be tacked to the surfaces of the existing walls. Both are undesirable. The service zone 14 of the present invention eliminates these problems.

Figure 5:
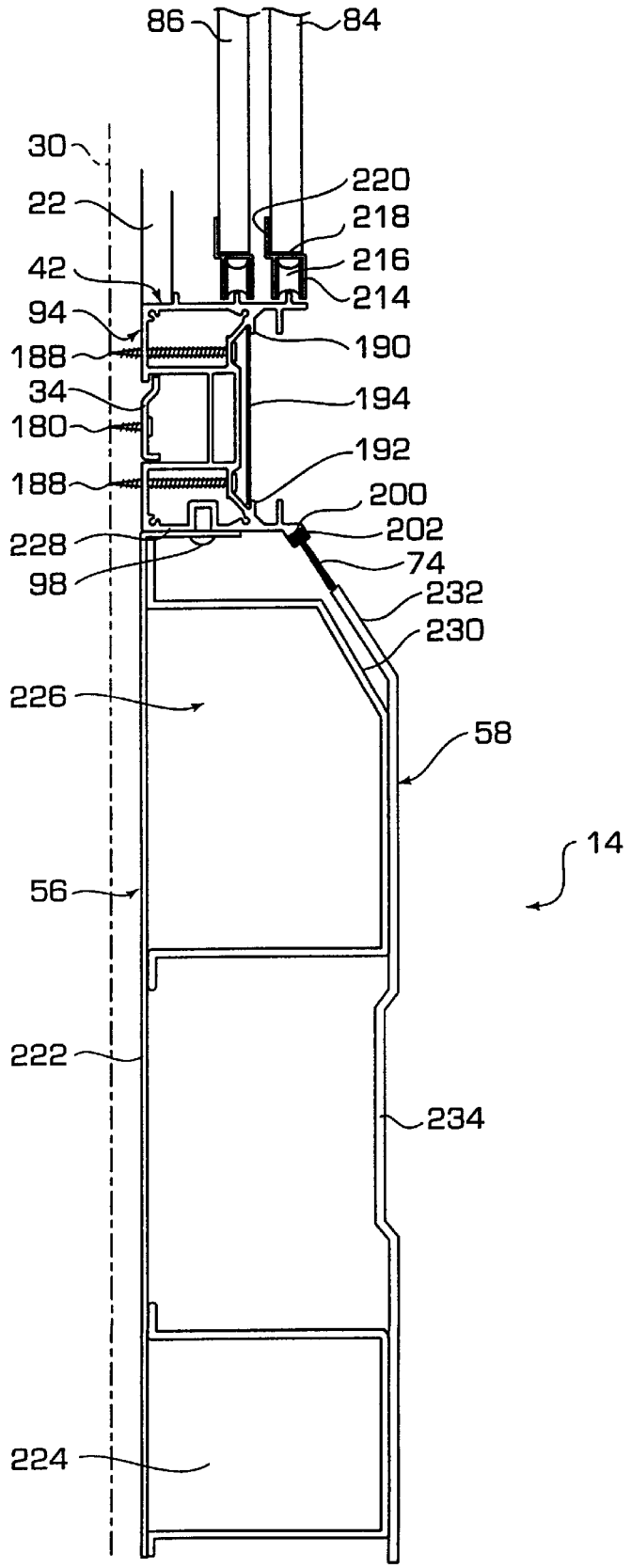
FIG. 5 is a side view showing the details of the lower rail, the lower ends of the rail panels, the lower roller assemblies for the rail panels of the wall assembly, and an end view of the service zone of FIG. 2A.

A plurality of service brackets 56 are affixed at spaced locations directly to existing walls 30. Brackets 56 are made of rigid strap material shaped as shown to support and space a plurality of service zone access panels 58 away from wall 30 (FIGS. 3B and 5 show side views of brackets 56). It will be appreciated that brackets 56 themselves take up very little room between panels 58 and wall 30. A large interior 60 for wire and cable management and storage is thereby created between wall 30 and panels 58. Hook and loop fastener patches 62 mate with complementary hook and loop fastener patches (not shown) on the inside surfaces of panels 58 to removably mount panels 58 to brackets 56. (In order for them to be visually distinguishable from their associated full vertical surface areas, patches 62 are shown covering less than said surface areas; in practice, patches 62 preferably cover their entire associated areas.)

A plurality of wire managers 64, which consist of plastic pads with snap-in slots for wires and cables, are attached to brackets 56 as shown. If electrical and communication outlets 66 are available, plugs and jacks may be connected directly thereto to provide power and data capabilities. If no such outlets are present, wires and cables are routed through various wire management channels to be described hereinafter. An endcap 68 covers any exposed end of service zone 14.

As can be seen in FIGS. 2A (right-hand side), 3B, 5, 7, and 8, when panels 58 are secured to brackets 56, a gap 70 remains between the top edge 72 of panels 58 and lower rail 20. Gap 70 extends the full length of service zone 14 and provides access to the interior 60 thereof. Wires and/or cables are capable of exiting at any point along gap 70 as needed. Gap 70 is covered by brush strip 74 which is affixed to lower rail 20, as will be described in more detail later.

Service zones 14 provide control of wires and cables and protect them from accidental damage, while hiding them from view. Service zones 14 also provide quick access to wires and cables. Wire managers 64 and the open space between wire managers 64 and panels 58 simplify rerouting of wires.

FIGS. 1–5 show wall assembly 12 and service zone 14 in use together. This has been done to conserve drawing space. It is readily apparent that each system can be used independently of the other, should the circumstances so require.

FIGS. 3–5, 10A, and 10B show details of wall assembly 12 and service zone 14.

Figure 3A:
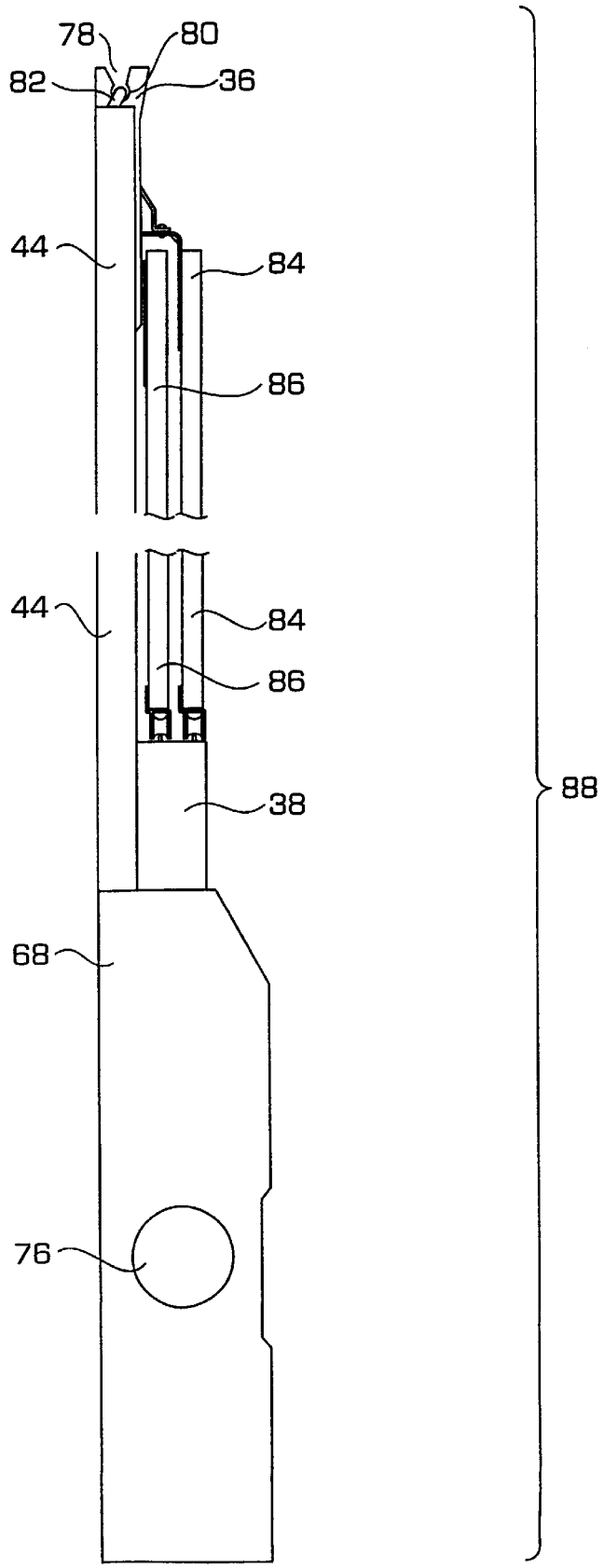
FIG. 3A is a side view of the wall assembly and service zone of FIG. 2A, broken off for clarity.
Figure 3B:
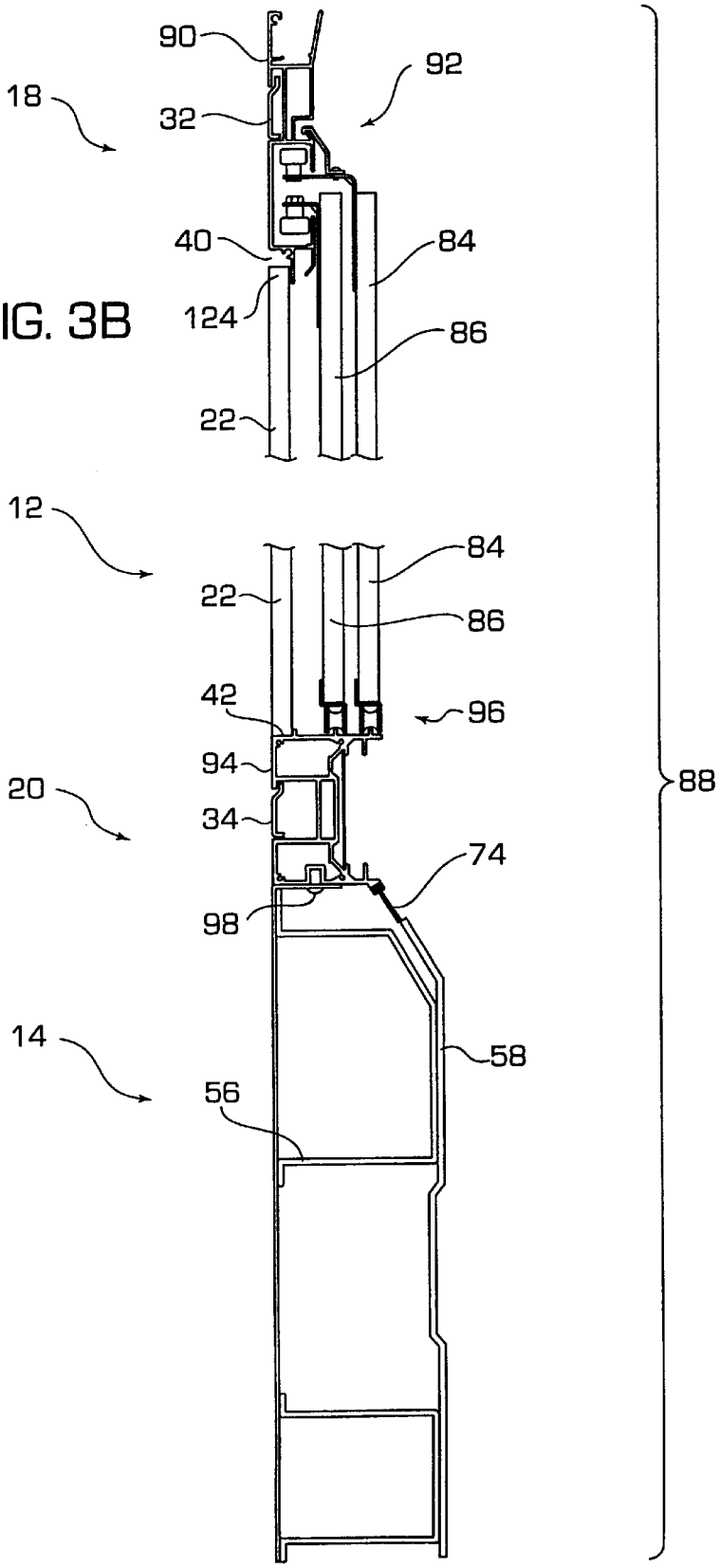
FIG. 3B is a side view of the wall assembly and service zone of FIG. 2A with the endcaps removed.

Referring first to FIG. 3A, it is a side view of the combination wall assembly 12 and service zone 14. Endcap 68 is shown in this embodiment with a grommet hole 76 (shown exaggerated in size for clarity) through which wires and cables can alternatively be fed, if, unlike FIG. 2A, no existing outlets are available on wall 30. Lower endcap 38 covers the end of lower rail 20, and tackboard endcap 44 covers the edge of tackboard 22. The top edge of upper endcap 36 can be seen just above and in front of tackboard endcap 44. Endcap 36 includes a funnel-shaped slot 78 at its top that leads to a partially open, circular aperture 80 (see also FIG. 2A). Slot 78 guides a cable 82 into aperture 80 where it is constrained as it passes, as seen in FIG. 2B, from upper rail 18 into wire manager channel 52 of tackboard endcap 44.

Also shown in FIG. 3A are two rail mounted panels, a front rail mounted panel 84 and a rear rail mounted panel 86. (Front rail mounted panel 84, rear rail mounted panel 86, tackboard 22, tackboard endcap 44, and wall 30 in FIGS. 3A–3B are broken away, as indicated in both figures by braces 88, with the central portion of each being eliminated from the drawings. This permits illustrating wall assembly 12 on a single sheet with the components thereof still being large enough to clearly see their details.) Front rail mounted panel 84 and rear rail mounted panel 86 are supported by rollers for parallel, rolling movement along wall assembly 12, as will be described in more detail later.

Front and rear rail mounted panels 84 and 86 can be any one of a number of accessories provided by the modular office furniture system of the present invention 84 and 86. Such accessories are typically either shelving or markerboards. By being mounted to move parallel to each other in an overlapping relationship, displays on the writing surfaces of the markerboards can be juxtaposed or spaced apart in either direction, permitting considerable versatility when making involved, complicated presentations.

Referring now to FIG. 3B, an end view of the combination wall assembly 12 and service zone 14 can be seen with endcaps 36, 38, 44, and 68 (from FIG. 3A) removed. More particularly, wall assembly 12 includes upper rail 18 and lower rail 20 with tackboard 22 and front and rear rail mounted panels 84 and 86 extending between them. Upper rail 18 includes an upper extrusion 90 which guides a set of upper roller assemblies 92 attached to the upper edges of panels 84 and 86. Lower rail 20 includes a lower extrusion 94 on which ride a corresponding set of lower roller assemblies 96 attached to the bottom edges of panels 84 and 86. Upper extrusion 90 is hooked onto upper hanger bracket 32, and lower extrusion 94 is hooked onto lower hanger bracket 34.

Service zone 14 includes service brackets 56, service access panel 58, and brushstrip 74. Service brackets 56 are connected to the base of lower extrusion 94 by Christmas tree fasteners 98.

Figure 10A:
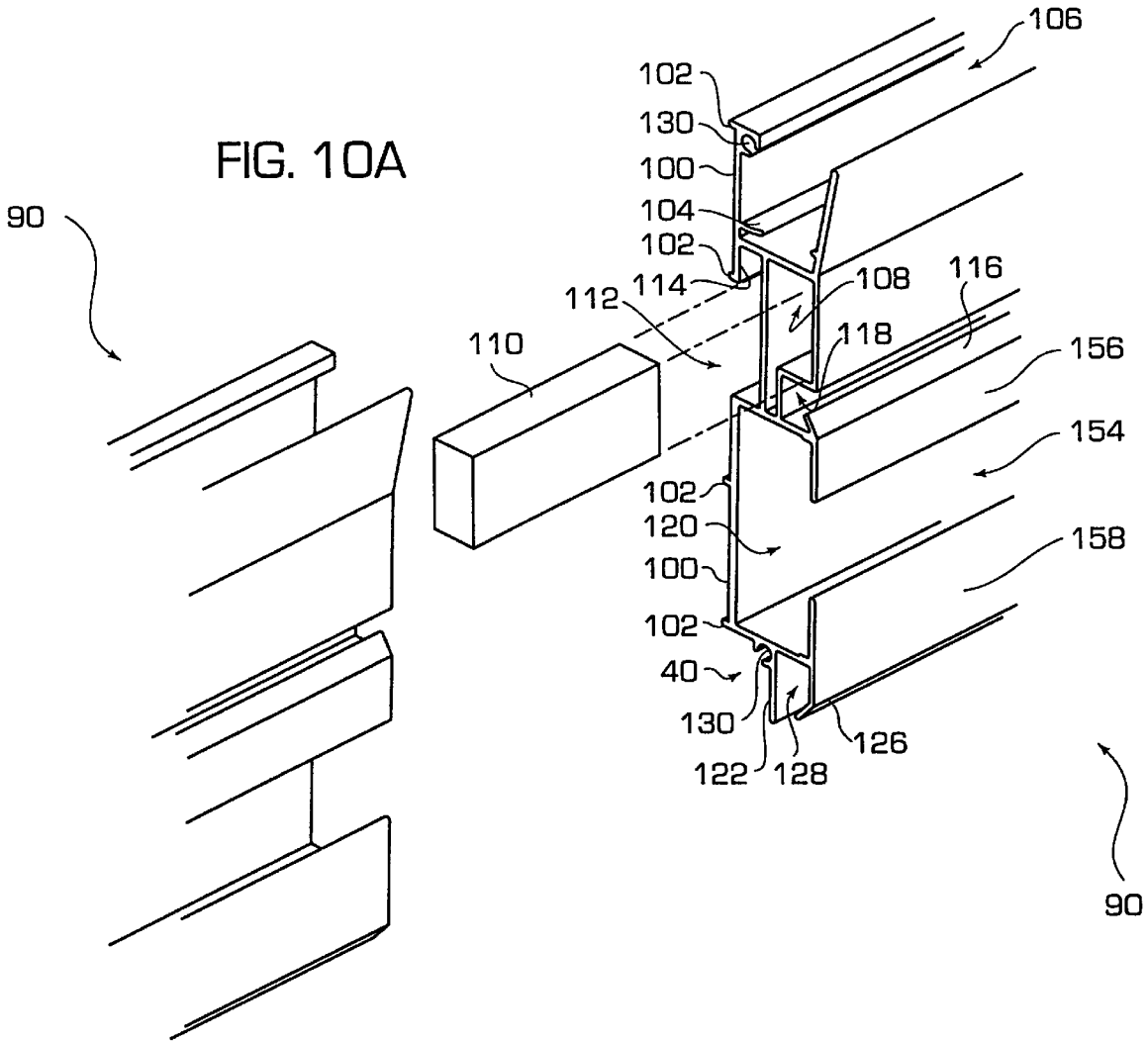
FIG. 10A is a perspective view showing an upper extrusion and the joining of the ends of adjacent upper extrusions of the upper rail assembly of the present invention.

A segment of upper extrusion 90 is shown in a perspective view in FIG. 10A and comprises a unitary structure, typically of extruded aluminum, having a plurality of vertical, horizontal, and sloping walls arranged preferably as shown to define a plurality of slots, channels, and openings, each with its own purpose. The cross-section shown is projected uniformly throughout the length of upper extension 90.

Figure 4:
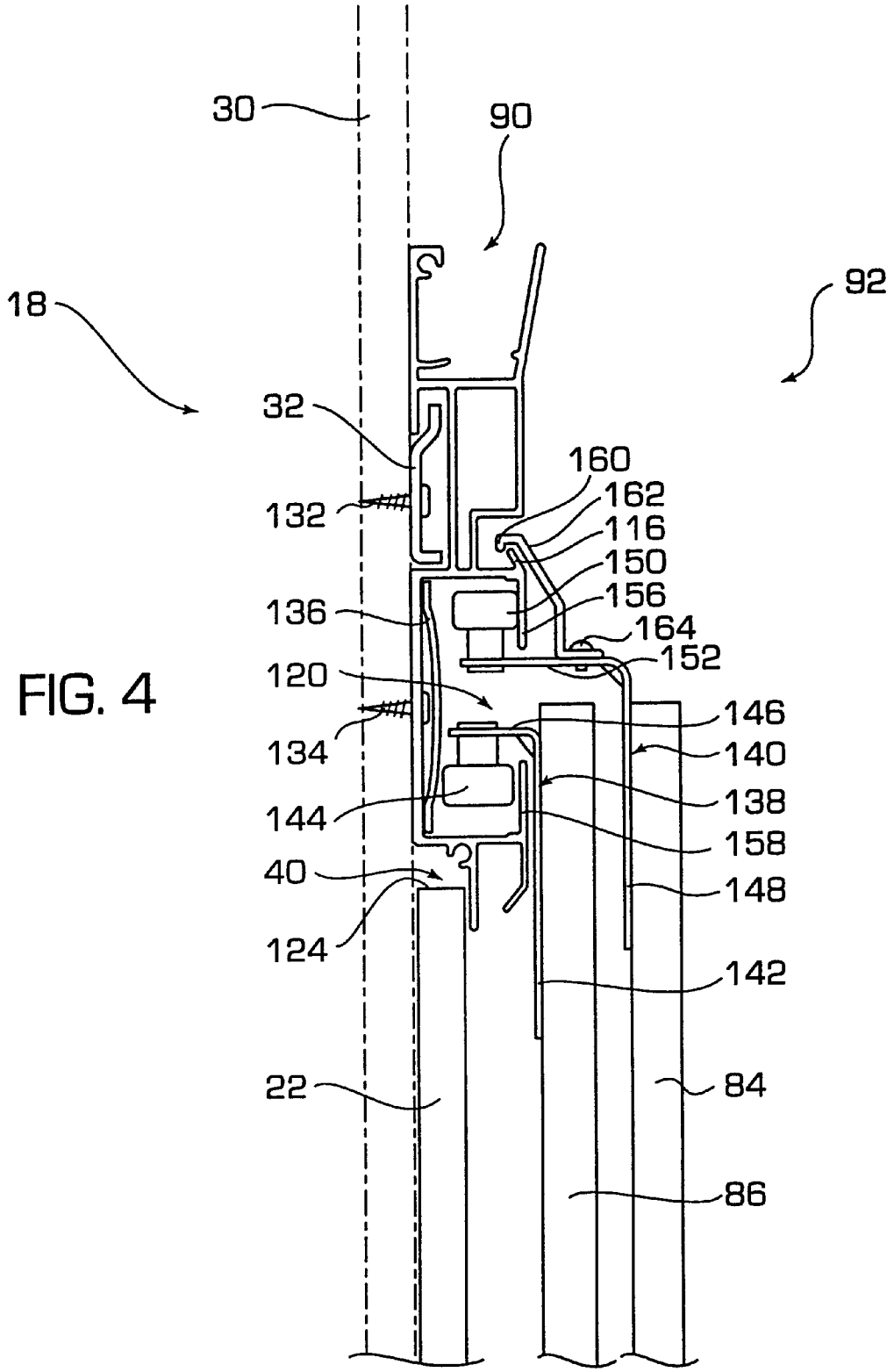
FIG. 4 is a side view showing the details of the upper rail, the upper ends of the rail panels, and the upper roller assemblies for the rail panels of the wall assembly of FIG. 2A.

More particularly, upper extrusion 90 comprises back walls 100 that have ridges 102 which abut wall 30 and act to space upper extrusion 90 therefrom while adding strength. An inner flange 104 provides a lip on which accessories such as lamps (not shown) may be hooked. An upwardly facing channel 106 acts as a wire manager for wires and cables which are housed unobtrusively therein due to its elevated location. The open top facilitates handling of the wires and cables. A boxed passage 108 is located below channel 106 and adds strength to upper extrusion 90 while providing a means to easily link multiple upper extrusions by snugly fitting a linking pin 110 therein. (Linking pin 110 is shown abbreviated in length for clarity in the drawing; in practice it is as long as is needed for stability.) A recess 112 provides space for upper hanger bracket 32 which coacts with overhanging flange 114 to support upper rail 18. A retainer lip 116, a retainer slot 118, and an upper roller assembly guide 120 will be described in more detail below relative to FIG. 4. A downwardly extending flange 122 frames notch 40 which receives and constrains the top 124 of tackboard 22, as is also shown in FIGS. 2A, 3B, and 4. An inwardly inclined flange 126 partially covers a paper-holding slot 128. A cylindrical rod (not shown) fits loosely in slot 128 to pinch and hold paper sheets inserted therein. Finally, a pair of tubular openings 130 receive fasteners, e.g., conical projections on the interior surface of endcap 36 (not shown) which snap-fit into tubular openings 130. Of course, any other appropriate removable fastener can be used, such as screws.

Turning back to FIG. 4, upper rail 18 and upper roller assemblies 92 are shown in a side view in more detail. Wall 30 is indicated in dashed lines, to which upper hanger bracket 32 is secured by screws 132. Upper extrusion 90 is hooked onto hanger bracket 32 and then fastened to wall 30 by screws 134. A C-shaped hardware cover 136 is slid or snapped into place within upper roller assembly guide 120 to cover screws 134 and present a clean, finished appearance. The top 124 of tackboard 22 is snapped into notch 40 and front and back rail mounted panels 84, 86 are inserted into place in upper roller assembly guide 120.

Upper roller assemblies 92 comprise two pair of back panel roller brackets 138 and two pair of front panel roller brackets 140, only one of each being visible in this side view. Each back panel roller bracket 138 includes an inverted L-shaped mounting bracket 142 and a roller 144, whose axle is welded or peened to an inwardly extending arm 146 of bracket 142 (a bolt may be used, but is not preferred, since the corresponding nut occupies an inordinate amount of space). Roller 144 extends downwardly from bracket arm 146. Each bracket 142 is fixedly attached by screws or the like adjacent a top corner on the rear surface of back rail mounted panel 86. Each front panel roller bracket 140 comprises in like manner an inverted L-shaped mounting bracket 148 and a pair of rollers 150 whose axles are welded or peened to an inwardly extending arm 152 of bracket 148. Rollers 150 extend upwardly from bracket arm 152. Each bracket 148 is fixedly attached by screws or the equivalent adjacent a top corner on the rear surface of front rail mounted panel 84.

Referring both to FIGS. 4 and 10A, the mounting of front and back rail mounted panels 84, 86 to upper rail 18 will now be described. Back panel 86 is mounted first by inserting rollers 144 and arms 146 through the slot 154 formed by confronting flanges 156 and 158 of upper extrusion 90 (FIG. 10A) and lowering rollers 144 in place behind flange 158. The weight of back rail mounted panel 86 is supported at its lower end, as will be described below relative to FIGS. 5 and 10B, with flange 158 guiding rollers 144 for rolling movement along upper extrusion 90. Rollers 150 and arms 152 are next inserted through slot 154 while front panel 84 is held at an angle away from wall assembly 12. When front panel 84 is rotated to vertical, rollers 150 will assume their proper position behind flange 156 which guides them for rolling movement along upper extrusion 90; the weight of front panel 84 is also supported from below. When in use, panels 84 and 86 naturally lean forward, biasing rollers 144 and 150 against the back surface of flanges 158 and 156, but bracket arms 146 and 152 are long enough to permit sufficient play for rollers 144 and 150 to bounce against hardware cover 136 prior to panels 84 and 86 coming into contact with surfaces thereunder. A hook 160 of a safety catch plate 162 is hooked over lip 116, and catch plate 162 is secured to arm 152 by screw 164. The combination functions as a safety catch which prevents derailment.

Each roller is seen to bracket include two rollers per bracket. While this is the preferred embodiment, it is within the purview of the invention to include more or less rollers, as the need dictates. For example, heavy accessories such as bookcases may require more rollers per bracket and/or more brackets per panel, whereas light accessories, e.g., tackboards, may do with one roller per bracket.

Figure 10B:
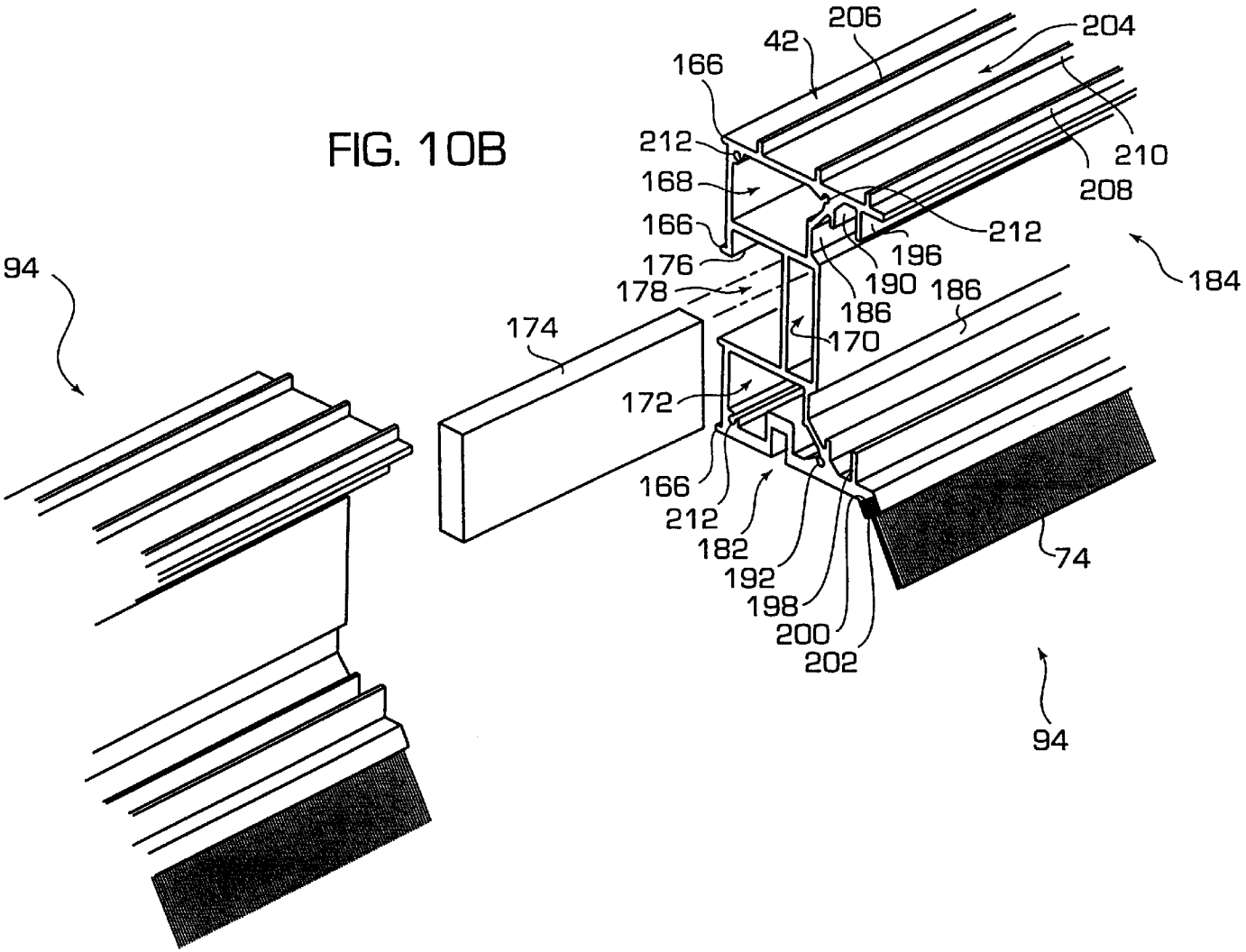
FIG. 10B is a perspective view showing a lower extrusion and the joining of the ends of adjacent lower extrusions of the lower rail assembly.

Referring now to FIG. 10B, a perspective view is shown of a segment of lower extrusion 94 which, like upper extrusion 90, comprises a unitary structure, typically of extruded aluminum, having a plurality of vertical, horizontal, and sloping walls preferably as shown to define a plurality of slots, channels, and openings. The cross-section shown is projected throughout the length of lower extension 94.

Upper extrusion 90 functions primarily as a guide for upper roller assemblies 92 and secondarily as a wire management means, where needed. Consequently, it is designed to support relatively little weight. Lower extrusion 94, on the other hand, must bear the weight of all of the tackboards, markerboards, bookcases, shelves, etc., which might be loaded thereupon. Its design reflects this added requirement.

As with upper extrusion 90, lower extrusion 94 includes ribs 166 which space lower rail 20 from wall 30 and provide added strength. Extra strength is also provided by enclosing more passages; three, 168, 170, and 172, have been found to be sufficient. Passage 170 doubles as the recipient of a linking pin 174 for linking multiple lower extrusions 94. A depending flange 176 overhangs the entrance to slot 178 which receives lower hanger bracket 34, fixed to wall 30 by screws 180 (FIG. 5), to support lower rail 20. A longitudinally extending slot 182 has internal thread-like ribs (not shown) for bindingly gripping Christmas tree fasteners 98 anywhere along its length.

Referring to both FIGS. 5 and 10B, concave face 184 of extrusion 94 includes several important features. A pair of recessed strips 186 provide sunken places for screws 188 (FIG. 5) which traverse passages 168 and 172 to secure extrusion 94 to wall 30. As many holes for screws 188 as are necessary are drilled periodically along strips 186, particularly in alignment with wall studs, to provide whatever stability is needed for this weight-bearing element. A pair of facing flanges 190 and 192 constrains a hardware cover 194 (FIG. 5) after it has been snapped or slid into place to conceal screws 188 and present a finished appearance. A pair of confronting flanges 196 and 198 are formed near the front edge of concave face 184 for a purpose to be explained later.

A U-shaped slot 200 running along the lower front edge of lower extrusion 94 snugly receives a base 202 of brush strip 74.

Top surface 204 of extrusion 94 has three upstanding, longitudinally extending ribs 206, 208 and 210 thereon. Rib 206 defines one side of tackboard supporting and confining notch 42. Ribs 208 and 210 constitute front and back tracks along which front and back rail mounted panels 84 and 86 travel.

As in extrusion 90, a plurality of tubular openings 212 are provided for fastening an endcap 38 (not shown in FIGS. 5 or 10B) to exposed ends of extrusion 94.

Figure 8:
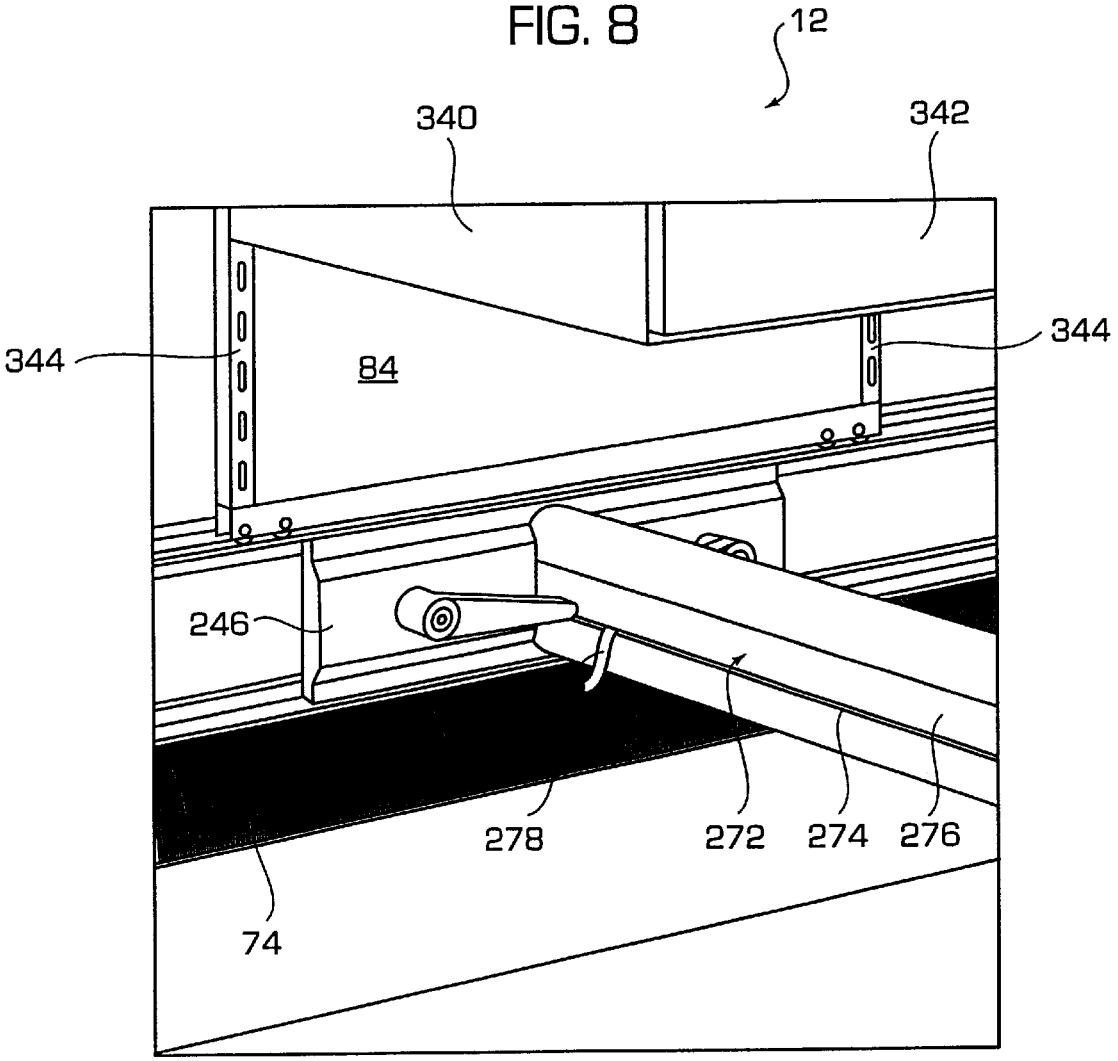
FIG. 8 is a perspective view of the outrigger beam attachment to the lower rail assembly.

As shown in FIG. 5, each lower roller assembly 96 comprises an elongated extrusion 214 shaped in cross-section like a lower-case "h" with rollers 216 spaced therealong. Extrusion 214 underlies the full length of the bottom edge of its associated panel 84 or 86, which rests on a top surface 218. An upstanding arm 220 is affixed to the inside bottom edge of its panel. In a variation of extrusion 214, a rib may be added along the front edge of top surface 218 to form a U-shaped notch for panel 84. It has been found in practice that two rollers 216 journalled at each bottom corner of the panel is sufficient to support the panel (FIG. 8).

FIG. 5 also shows a side view of service zone 14. Service bracket 56 comprises a rear strip 222, a lower box 224, an upper box 226, and a short horizontal strip 228 at the top thereof. Strip 228 includes an elogated aperture (not shown) through which a Christmas tree fastener 98 passes to fasten bracket 56 to lower extrusion 94. Upper box 226 includes an angled portion 230 to make room for an upper inclined portion 232 of access panel 58. A longitudinal indentation 234 runs the length of panel 58. Inclined surface 232 and indentation 234 are not just for decorative purposes; they also resist torsioning and crimping of panel 58. It can be seen that wires and cables can easily be run in, through, and around service brackets 56 and can exit through brush strip 74 anywhere along the length of service zone 14. This function is important to the modular office furniture system of the present invention, since it permits placement of tethered work surfaces anywhere along wall assembly 12, as will now be described.

Returning to FIG. 1, the utility area 16 is shown in a perspective view. In this embodiment, the utility area is defined by tethering a work surface 236 to wall assembly 12 by means of an outrigger beam 238. Work surface 236 preferably comprises a planar table top with no drawers. It can have a virtually unlimited variety of outlines including oval, kidney, pie-shaped, arcuate, elongated, keyhole, expanding, etc., selected to promote a particular function, be it a conference table, study table, or computer center.

Outrigger beam 238 is releasably connected at one end to lower extrusion 94 by a clamping plate assembly 240 and at the other end to a free-standing pedestal 242. Clamping plate assembly 240 is shown in more detail in FIGS. 7–8 and 11. Work surface 236 is mounted on pedestal 242 for rotation about an axis which is preferably locate d nearer to one end of work surface 236. The free end of work surface 236 is supp orted by Y-legs 244.

Figure 6:
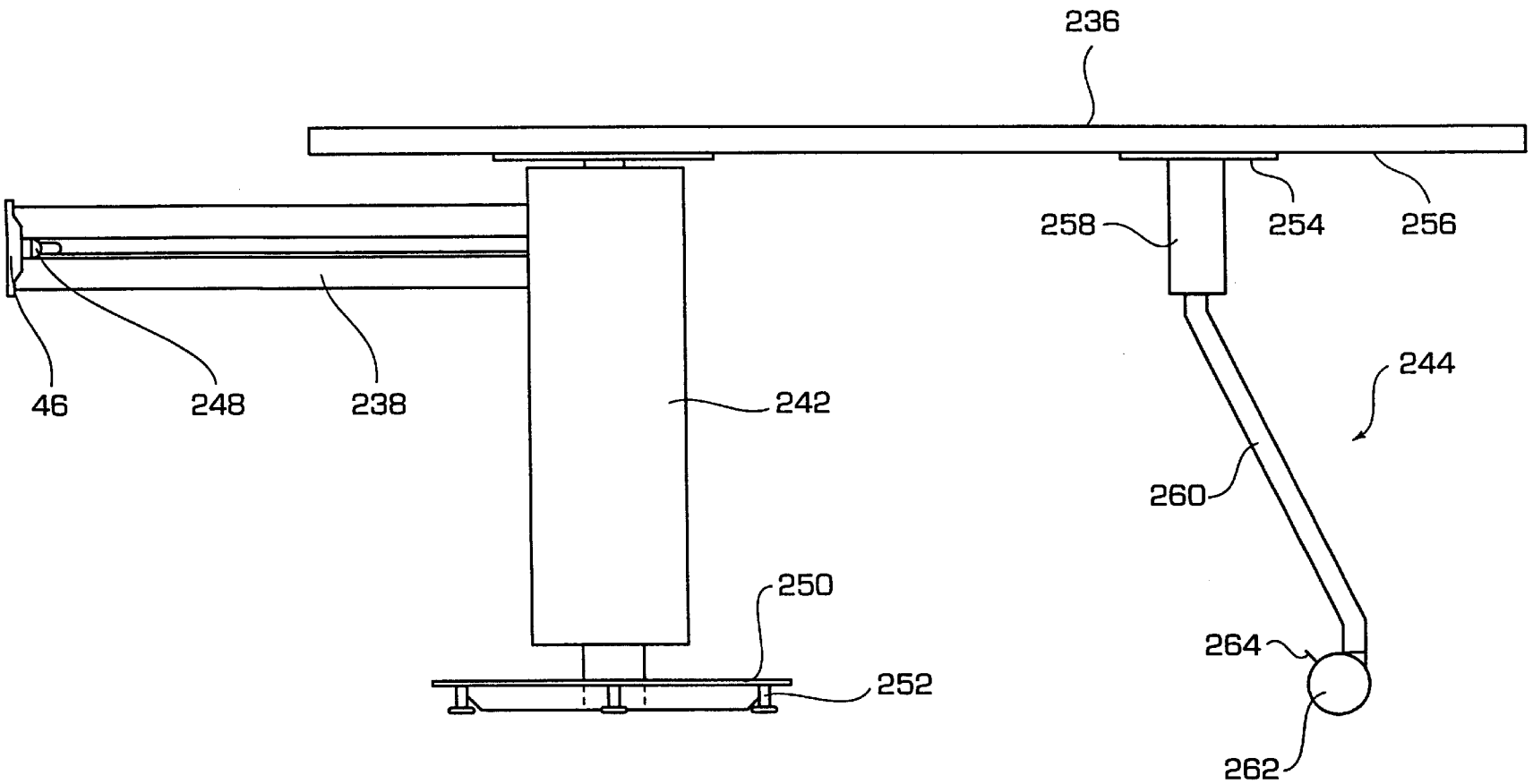
FIG. 6 is a side view of the pivoting table assembly of the present invention including the outrigger beam, pedestal, legs, and work surface.

A side view of the arrangement is shown in FIG. 6 where a clamp face plate 246 is attached to one end of outrigger beam 238 by mea ns of screws (not shown) penetrating axially into outrigger beam 238 through face plate 246. The other end of outrigger beam 238 is similarly affixed to pedestal 242 by means of axial screws (see FIG. 9). A pair of clamp handles 248 actuate means which clamp outrigger beam 238 to wall assembly 12. Pedestal 242 rests atop a base 250 which is levelled and adjusted for height by means of five threaded feet 252. Y-legs 244 comprise a plate 254 fastened to the bottom surface 256 of work surface 236 , a cylindrical tube 258, and a pair of legs 260. Plate 254, tube 258, and legs 260 are integral with each other. Each of the pair of legs 260 have a swivel-type roller 262 on its free end. A manual brake 264 is fitted to each roller 262 to lock work surface 236 at the selected orientation. The extent of utility area 16 is essentially defined by the rotation a rc of work surface 236 and th e associated furniture, chairs and oth er mob ile accessories such as bookcases, mobile markerboards, filing cabinets, etc. Tube 258 is long enough so that legs 260 pass beneath outrigger beam 238, thus providing freedom of motion for virtually a 360° rotation around pedestal 242. This degree of freedom allows the work area to be expanded or contracted, dependent upon the angular location of the work surface relative to pedestal 242, to quickly adapt to changing needs for floor space utilization.

Figure 7:
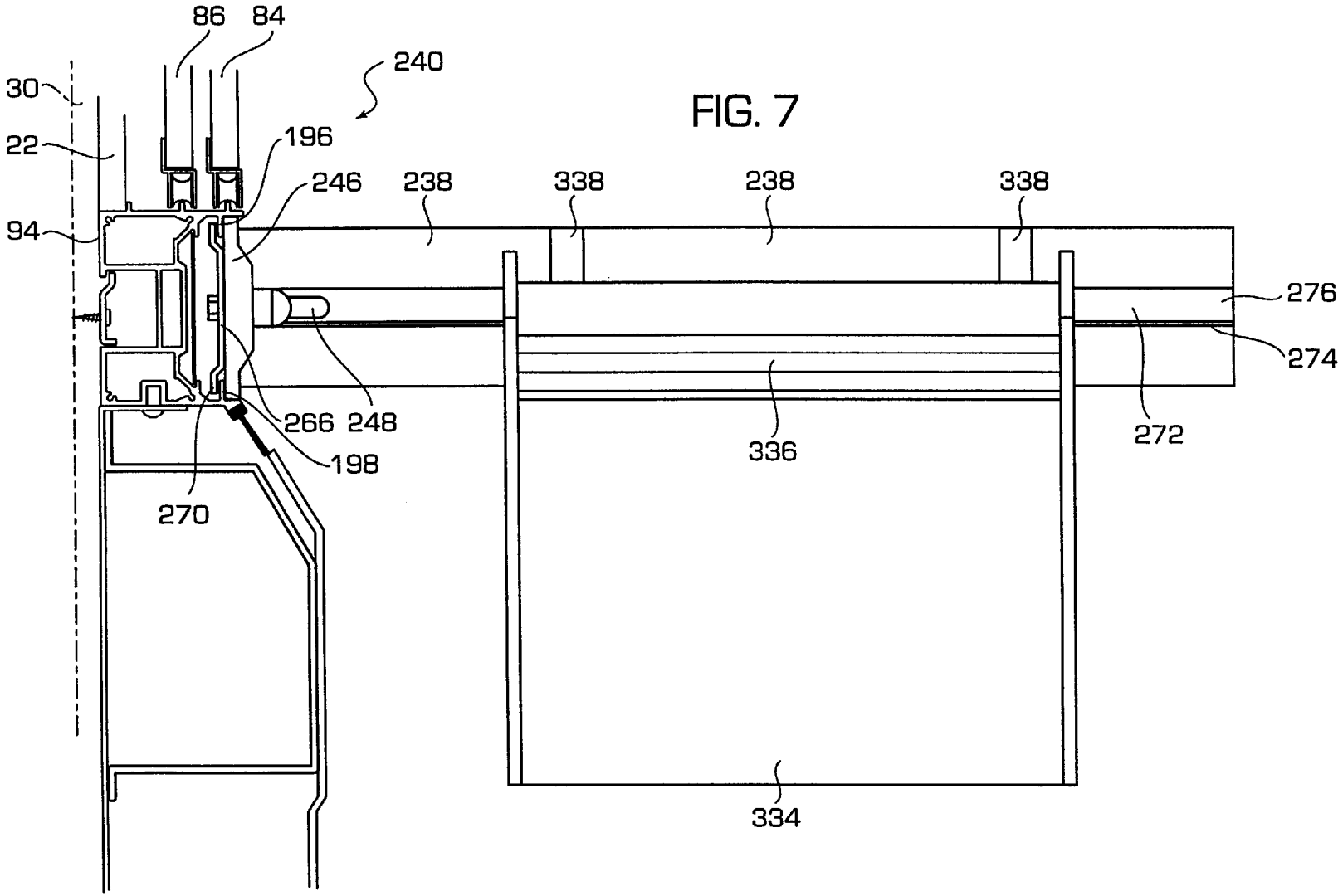
FIG. 7 is an end view of the lower rail assembly and a side view of the outrigger beam showing their attachment.
Figure 11:
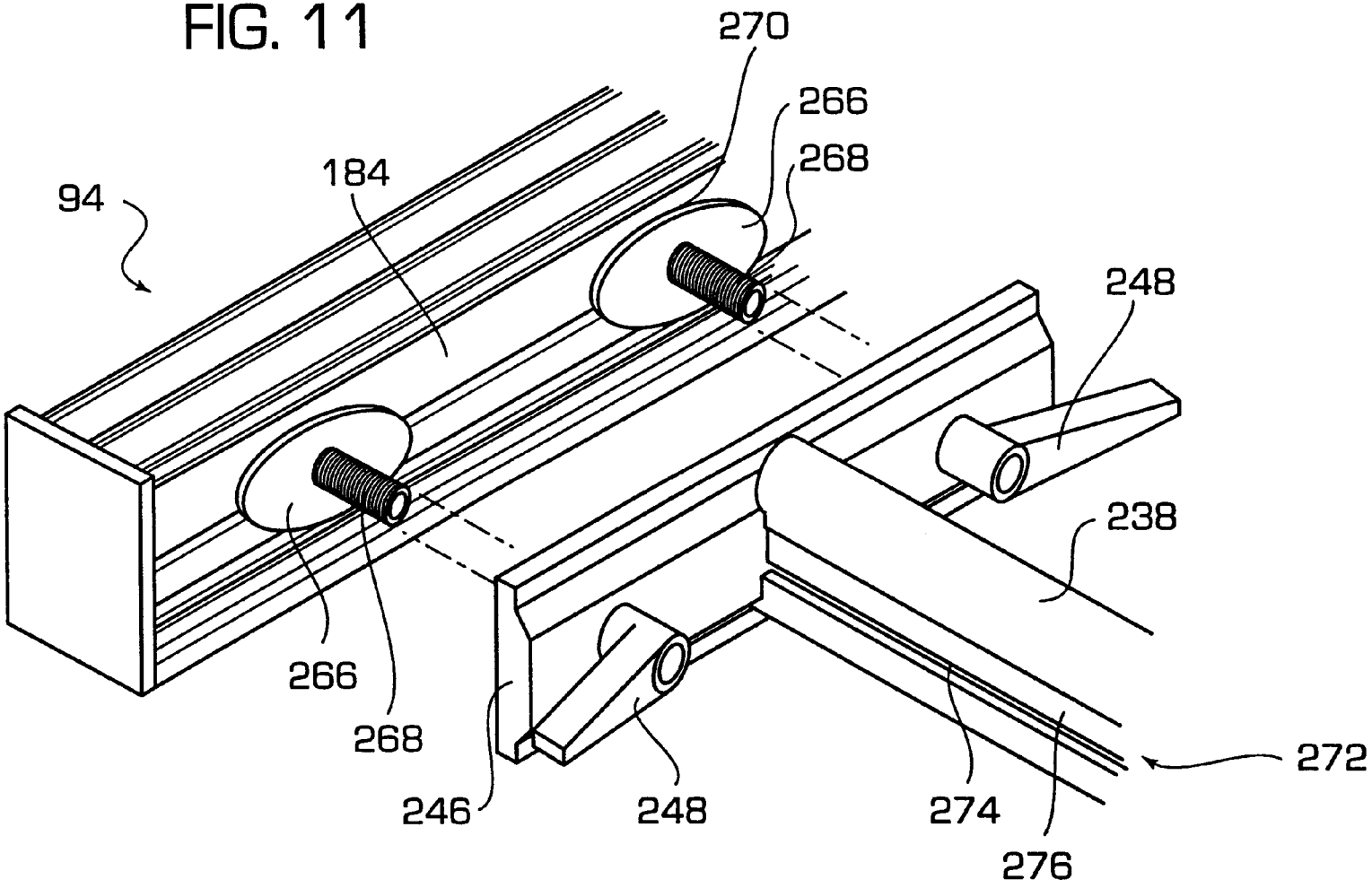
FIG. 11 is an exploded perspective view of the attachment of the outrigger beam to the lower rail assembly as in FIGS. 7 and 8.

FIGS. 7 and 11 show the manner of releasably connecting outrigger beam 238 to lower extrusion 94. Each of a pair of non-circular, e.g., oval, clamping plates 266, preferably made of steel, have welded thereto a solid, orthogonally extending, threaded stem 268. Plates 266 can have their rims 270 off-set relative to the plane of the plates, as can be seen more clearly in FIG. 7. While an off-set rim is desirable, it is not critical, as a flat plate will also function. Handles 248 are internally threaded (not shown) to mate with threaded stems 268. To attach outrigger beam 238 to wall assembly 12, clamping plates 266 are oriented as shown in FIG. 11 and inserted into concave face 184. As handles 248 are rotated clock-wise, clamping plates 266 are frictionally forced to also rotate clock-wise slightly, placing rims 270 behind confronting flanges 196 and 198 (FIG. 7). Continued rotation of handles 248 causes clamping plates 266 and face plate 246 to clamp confronting flanges 196, 198 therebetween. Outrigger beam 238 is then tightly, but releasably, secured to wall assembly 12. It will be appreciated that clamping plate assembly 240 is easily connected to extrusion 94 in an infinity of incremental positions along lower rail 20. The location of utility area 16 is thereby amenable to an infinity of selections, also.

Also shown in FIGS. 7 and 11 is a wire manager 272 incorporated into outrigger beam 238. Wire manager 272 is similar to the wire manager 52 built into tackboard endcap 44 in that a channel 274 is formed along one side, or both sides, of outrigger beam 238. A flexible flap 276 covers channel 274. FIG. 8 shows outrigger beam 238 attached to wall assembly 12. An electrical or communications cable 278 is shown exiting service zone 14 through brush strip 74 and entering the wire manager 272 on its way to a utilization device, e.g., a computer, on work surface 236. It can be seen that service is provided in a quite unobtrusive manner with minimal exposure of wires or cables. One of the advantageous benefits of modular office furniture system of the present invention is that all services are provided to any of the work surfaces without having unsightly wires and cables littering the workspace. A clean, neat office which presents a pleasing, professional impression is therefore attainable.

Figure 9:
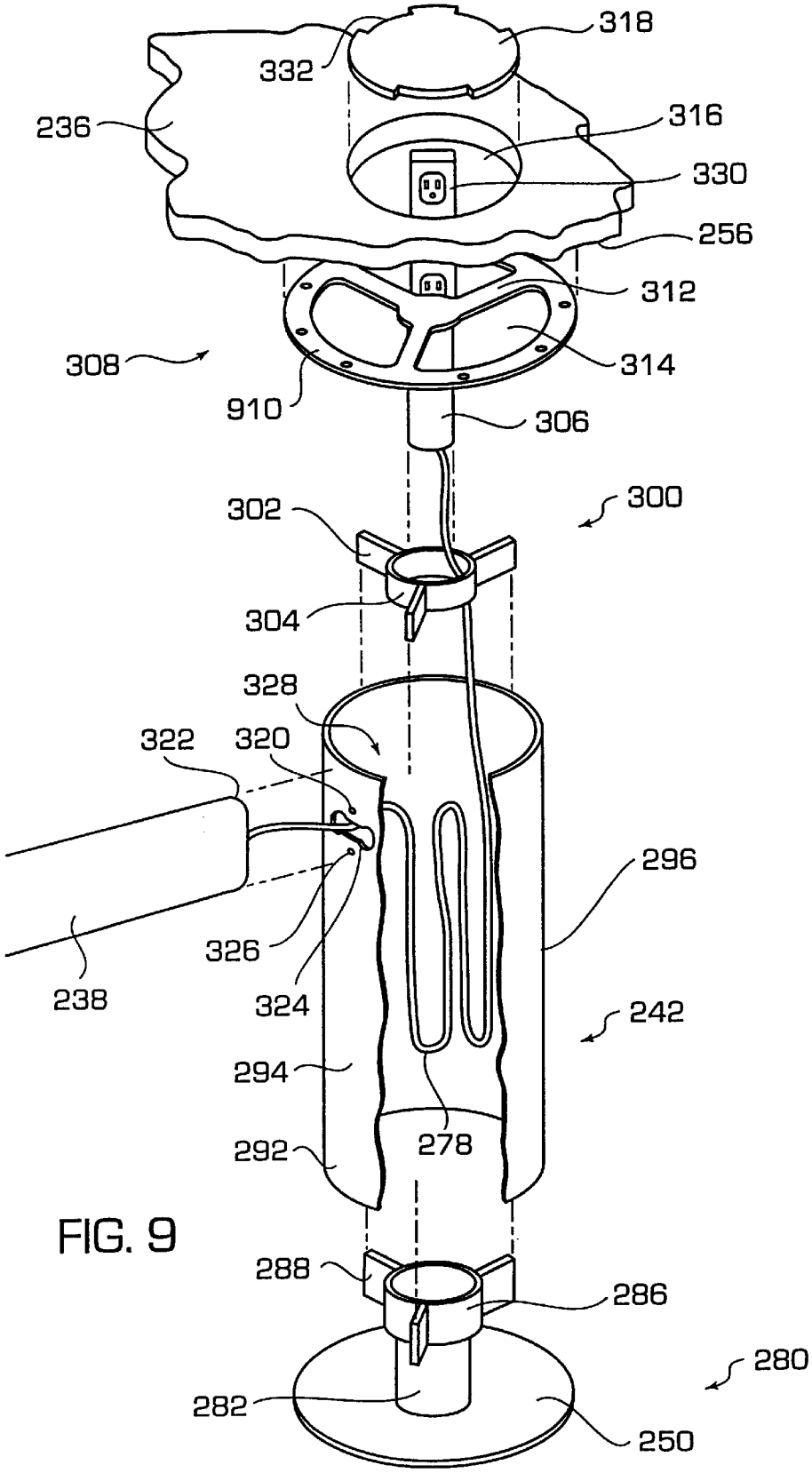
FIG. 9 is an exploded perspective of the pedestal and the outrigger beam.

The structure of pedestal 242 is shown in an exploded view in FIG. 9. Pedestal 242 is supported by a base unit 280 comprising base 250, a stub 282, and a lower wheel-like plinth 284 including a tubular hub 286, a set of radial vanes 288 which are welded to a cylindrical sleeve 294. Base unit 280 is a rigid, integral structure. The lower end 292 of cylindrical sleeve 294 is fixed by any appropriate means to the outer surfaces of radial vanes 288. The upper end 296 of cylindrical sleeve 294 is similarly fixed to the outer surface of radial vanes 302 of an upper wheel-like plinth 300. Radial vanes 302 support a tubular hub 304 in plinth 300. Plinth 300 is also a rigid, integral structure. The depending axle 306 of a swivel plate 308 is journal led within tubular hub 304 for free rotation about the longitudinal axis of pedestal 242. Swivel plate 308 comprises an outer ring 310 connected to axle 306 by a small number of radial arms 312, preferably three. Pie-shaped apertures 314 are thereby formed within the periphery of swivel plate 308. Swivel plate 308 is attached to bottom surface 256 of work surface 236, axially aligned with a circular aperture 316 through work surface 236. A removable grommet 318 covers aperture 316.

Outrigger beam 238 is attached to cylindrical sleeve 294 by means of screws or bolts passing through screw holes 320 opening toward the end wall 322 of outrigger beam 238. A kidney shaped aperture 324 through the side wall 326 of cylindrical sleeve 294 provides communication from wire manager 272 of outrigger beam 238 to the interior 328 of cylindrical sleeve 294 for cable 278. The open interior 328 of cylindrical sleeve 294 provides a storage area for excess lengths of cable 278 and any mobile electrical unit, e.g., a power strip 330. The utility of pie-shaped apertures 314 in providing access to interior 328 for storage and retrieval of power strip 330 and cable 278 is readily apparent. Notches 332 spaced around the perimeter of grommet 318 allow other cables or wires, e.g., computer cables, telephone lines, etc., also stored in interior 328, to find access to the top of work surface 236.

Two accesories are shown in FIGS. 7 and 8. A saddlebag storage unit 334 (FIG. 7) with a lockable tambour door 336 is shown hanging from outrigger beam 238. A pair of straps 338, preferably rigid and hook-shaped, removably mount saddlebag 334 to outrigger beam 238. Depending on the length of outrigger beam 238 (most notably thirty and fourty-eight inches, but other lengths are clearly possible), more than one saddlebag can be added. Of course, saddlebags 334 can be replaced by file folders, magazine racks, pencil holders, or any other small storage device.

In FIG. 8, an open bookcase 340 with a small drawer 342 is removably attached to slotted standards 344 on each side of rail mounted panel 84. The use of slotted standards 344 on rail mounted panels allows for designing wall assembly 12 to include any type of accessory which is found useful at any given time, and to easily convert the workplace to another use by simply lifting one accessory off the panel and attaching another. For instance, shelf 26 seen in FIG. 1 is removably hooked onto slotted standards 344.

It may be appreciated that the versatility of the disclosed modular office furniture system of the present invention is virtually unlimited.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim as our invention:

1. A wall assembly for mounting to an existing wall, comprising:

a tackboard having a first top edge and a first bottom edge;

a rolling panel including a second top edge with top rollers attached and a second bottom edge with bottom rollers attached; and an upper rail and a lower rail;

said upper rail comprising a unitary extrusion having an upper wall attachment for attaching said upper rail to the existing wall, a wire management channel, guide flanges for guiding said top rollers, and an upper constraining flange for constraining said first top edge; and said lower rail comprising a unitary extrusion having a lower wall attachment for attaching said lower rail to the existing wall, a supporting said bottom rollers, and a lower constraining flange for constraining said first bottom lower edge.

2. The wall assembly of claim 1, wherein said upper and lower wall attachments each comprise a flanged recess, and upper and lower hanger brackets fixed to the existing wall and received into said flanged recesses of said upper and lower wall attachments, respectively.

3. The wall assembly of claim 1, wherein said upper and lower constraining flanges define notches which respectively receive said first top edge and said first bottom edge comprises a tackboard.

4. The wall assembly of claim 1 wherein said rolling panel is a markerboard.

5. The wall assembly of claim 4 wherein said markerboard comprises a whiteboard.

6. The wall assembly of claim 1 wherein said tackboard comprises a bulletin board made of a sheet of cork.

7. The wall assembly of claim 6 further comprising a plurality of tackboards, sufficient to cover the existing wall.

8. The wall assembly of claim 7 wherein said plurality of tackboards are covered with decorative coverings comprising materials, patterns, textures, and colors.

9. The wall assembly of claim 1 further comprising two of said tracks, spaced apart and parallel, and two of said rolling panels which are supported by said tracks for sliding, overlapping movement.

10. An electrical service panel assembly for attachment to a wall, comprising:

a plurality of horizontally spaced brackets fixed to the wall, each of said brackets including two vertically spaced panel-engaging surfaces;

a plurality of elongated, rectangular access panels removably attached to said brackets;

said access panels, when attached to said brackets, defining an elongated slot extending along the entire length of said access panels;

a flexible brush strip fixed relative to said access panels to cover said elongated slot; and said wall, brackets, and brush strip enclosing an interior volume for housing wires and cables, and wire managers for managing said wires and cables while permitting egress of said wires and cables through said brush strip at any point along said entire length of said slot.

11. The electrical service panel assembly of claim 10 wherein said brackets comprise a rigid strap material.

12. The electrical service panel assembly of claim 10, wherein said brackets have a horizontally extending portion and are serpentine shaped to provide a vertical, elongated wall-engaging surface spaced from said panel-engaging surfaces, said wall-engaging surface being joined to said panel-engaging surfaces by said horizontally extending portions of said brackets.

13. The electrical service panel assembly of claim 10, wherein said panels are removably attached to said brackets by Velcro patches.

14. The electrical service panel assembly of claim 10 wherein said wall is an existing wall.

15. The electrical service panel assembly of claim 14, wherein said existing wall includes existing electrical power outlets and data communication jacks.

16. The electrical service panel assembly of claim 10, further including endcaps to enclose said interior volume.

17. The electrical service panel assembly of claim 16, further including a grommet hole in each of said endcaps for the transmission of said wires and cables therethrough.

18. The electrical service panel assembly of claim 10, further comprising an elongated wall-mounted rail extending parallel above said slot, said brackets including an upper horizontally extending segment fastened to said rail, said brush strip being attached to said rail.

19. A work-area delineation system, comprising:

a room comprising a floor and at least one wall;

an elongated rail mounted on said wall, said rail extending parallel to said floor;

a work surface;

a free-standing pedestal, said work surface being pivotally supported by said pedestal; and an outrigger beam having a first end and a second end, said first end being slidably, releasably connected to one of a plurality of positions along the length of said rail and said second end being fixed to said pedestal.

20. The work-area delineation system of claim 19, wherein said rail further includes a first wire management channel for receiving power and communication wires and cables.

21. The work-area delineation system of claim 20, wherein said outrigger beam further includes a second wire management channel for receiving power and communication wires and cables.

22. The work-area delineation system of claim 21, wherein said pedestal further includes a third wire management channel for receiving power and communication wires and cables.

23. The work-area delineation system of claim 22, wherein said work surface further includes a wire management access port therethrough for permitting said wires and cables to egress from said pedestal onto said work surface.

24. The work-area delineation system of claim 21, wherein said second wire management channel comprises an open slot along one side, said slot being enclosed by a flexible flap fixed along one edge of said slot and open along the other edge.

25. The work-area delineation system of claim 19, wherein said pedestal comprises a lower end, a hollow body, and an upper end.

26. The work-area delineation system of claim 25, wherein said lower end comprises a unitary structure including a base, a stub, and a lower wheel-like plinth, said plinth including a tubular hub, a set of radial vanes, and a circumferential ring.

27. The work-area delineation system of claim 26, wherein said upper end comprises a unitary upper wheel-like plinth including a circumferential ring, radial vanes, and a tubular hub; and said hollow body comprises a cylindrical sleeve connected at respective opposite ends to said circumferential rings.

28. The work-area delineation system of claim 27, further including a swivel plate attached to the bottom surface of said work surface, said swivel plate comprising an outer ring and a depending axle connected thereto by a plurality of radial arms, said depending axle being journalled within said tubular hub for free rotation about the longitudinal axis of said pedestal.

29. The work-area delineation system of claim 28 wherein said plurality of radial arms of said swivel plate define pie-shaped apertures opening into a circular aperture through said work surface, and a grommet adjustably closing said circular aperture.

30. The work-area delineation system of claim 19, wherein said work surface is elongated and said pedestal pivotally supports said work surface nearer to one end of said work surface than the other end, said other end being supported by a leg structure having casters mounted thereon.

31. The work-area delineation system of claim 30, wherein said work surface is capable of substantially 360° rotation about said pedestal.

32. The work-area delineation system of claim 19, further including a saddlebag, said saddlebag comprising storage containers having support hooks thereon for removable attachment to said outrigger beam.

33. A modular office furniture system for designing office environments, comprising:

a wall assembly including an upper rail and a lower rail;

at least two rolling panels supported for parallel sliding movement along said upper and lower rails;

a service zone for supplying and managing electrical services which comprises brackets mounted to an existing wall, a plurality of panels removably mounted linearly along said wall beneath said lower rail, said panels and said lower rail defining a slot therebetween, and a brush strip mounted to cover said slot;

an outrigger beam having a first end and a second end, said first end being slidably, releasably connected anywhere along the length of said lower rail;

a free-standing pedestal, said second end of said outrigger beam being fixed to said pedestal; and a work surface, said work surface being pivotally supported by said pedestal.

34. The modular office furniture system for designing office environments of claim 33, further comprising a plurality of tackboards mounted between said upper and lower rails.

35. The system for designing office environments of claim 33 wherein said rolling panels support at least one accessory.

36. The modular office furniture system for designing office environments of claim 35 wherein said accessory is selected from the group consisting of markerboards, bookcases, laptop docks, presentation easels, cabinets, shelves, and accessory bars.

37. The modular office furniture system for designing office environments of claim 33, further including a system for wire management, comprising:

power and communication cables connected to power and communication sources within said existing wall;

said outrigger beam further including a wire management channel formed on one side thereof and extending along its length;

said pedestal further including a cable inlet, a hollow interior, and a cable outlet, said cable outlet being open to the top of said work surface, wherein said cables are stored within said service zone, exit through said brush strip anywhere along the length of said slot, traverse within said outrigger beam channel, enter said pedestal inlet, are stored in said hollow interior, and exit through said pedestal outlet to said work surface.

38. The system for designing office environments of claim 33 further including a saddlebag, which comprises a storage container having support hooks thereon for removable attachment to said outrigger beam.

* * * * *